US005078231A

United States Patent [19]

Davis

[11] Patent Number: 5,078,231

[45] Date of Patent: Jan. 7, 1992

[54] LADDER BASE PLATE APPARATUS

[76] Inventor: Allen N. Davis, 1410 Sheridan St., Albert Lea, Minn. 56007

[21] Appl. No.: 699,576

[22] Filed: May 14, 1991

[51] Int. Cl.[5] ..... E06C 7/46

[52] U.S. Cl. ..... 182/107

[58] Field of Search ..... 182/107, 108, 109, 111

[56] References Cited

U.S. PATENT DOCUMENTS

| | | | |
|---|---|---|---|
| 776,446 | 11/1904 | Williamson | 182/107 |
| 2,868,427 | 1/1959 | Hess | 182/107 |
| 2,962,112 | 11/1960 | Ramsberger | 182/107 |
| 3,435,912 | 4/1969 | Scherer | 182/107 |
| 4,669,576 | 6/1987 | Jones | 182/108 |

*Primary Examiner*—Reinaldo P. Machado

*Attorney, Agent, or Firm*—Leon Gilden

[57] ABSTRACT

A base plate includes a plurality of plate members, each formed with abutting flanges that are in turn orthogonally oriented relative to one another to provide a continuous abutment surface for a plurality of ladder legs of an associated ladder. The structure includes pins directed through each corner of the free ends of the base plates, and may further be provided with tether lines, with a plurality of the tether lines utilizing adjusting means for fixedly anchoring the ladder to the plate structure. Further refinement of the organization includes the flanges in hingedly intercommunicating relationship relative to one another to permit interfolding of the structure for ease of transport and storage.

5 Claims, 4 Drawing Sheets

LADDER BASE PLATE APPARATUS

BACKGROUND OF THE INVENTION

1. Field of the Invention

The field of invention relates to ladder apparatus, and more particularly pertains to a new and improved ladder base plate apparatus wherein the same is arranged for providing an anchoring member for positioning a ladder thereon to prevent slippage of the ladder in use.

2. Description of the Prior Art

Positioning of ladders to various underlying surfaces is frequently a hazardous and speculative procedure. Various structure is utilized in the prior art to position and anchor such ladders, but such structure is typically integral with a ladder organization or is of a cumbersome nature is minimize its usage. Such structures are exemplified in U.S. Pat. No. 3,618,703 to Wilke wherein a platform is pivotally mounted to a lower terminal end of ladder rungs in a fixed relationship to provide an enlarged platform for support of the associated ladder.

U.S. Pat. No. 4,669,576 to Jones, et al. sets forth a safety ladder wherein the lower terminal ends of the legs include sockets for receiving the ladder legs, and the sockets include projections for projection into an underlying ground surface.

U.S. Pat. No. 1,025,474 to Magoon sets forth a ladder foot structure wherein projecting spikes are mounted to lower terminal ends of the ladder legs.

U.S. Pat. No. 4,576,250 to Marish sets forth a ladder stop wherein projection structure is provided to hingedly receive lower terminal ends of ladder legs, wherein the projection structure is arranged for projection into an underlying ground surface.

As such, it may be appreciated that there continues to be a need for a new and improved ladder base plate apparatus as set forth by the instant invention which addresses both the problems of ease of use as well as effectiveness in construction in providing an anchor surface for a ladder and in this respect, the present invention substantially fulfills this need.

SUMMARY OF THE INVENTION

In view of the foregoing disadvantages inherent in the known types of ladder positioning structures now present in the prior art, the present invention provides a ladder base plate apparatus wherein the same is arranged to secure and position a ladder relative to a support surface. As such, the general purpose of the present invention, which will be described subsequently in greater detail, is to provide a new and improved ladder base plate apparatus which has all the advantages of the prior art ladder support apparatus and none of the disadvantages.

To attain this, the present invention provides a base plate including a plurality of plate members, each formed with abutting flanges that are in turn orthogonally oriented relative to one another to provide a continuous abutment surface for a plurality of ladder legs of an associated ladder. The structure includes pins directed through each corner of the free ends of the base plates, any may further be provided with tether lines, with a plurality of the tether lines utilizing adjusting means for fixedly anchoring the ladder to the plate structure. Further refinement of the organization includes the flanges in hingedly intercommunicating relationship relative to one another to permit interfolding of the structure for ease of transport and storage.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientistis, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder base plate apparatus which has all the advantages of the prior art ladder support apparatus and none of the disadvantages.

It is another object of the present invention to provide a new and improved ladder base plate apparatus which may be easily and efficiently manufactured and marketed.

It is a further object of the present invention to provide a new and improved ladder base plate apparatus which is of a durable and reliable construction.

An even further object of the present invention is to provide a new and improved ladder base plate apparatus which is susceptible of a low cost of manufacture with regard to both materials and labor, and which accordingly is then susceptible of low prices of sale to the consuming public, thereby making such ladder base plate apparatus economically available to the buying public.

Still yet another object of the present invention is to provide a new and improved ladder base plate apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
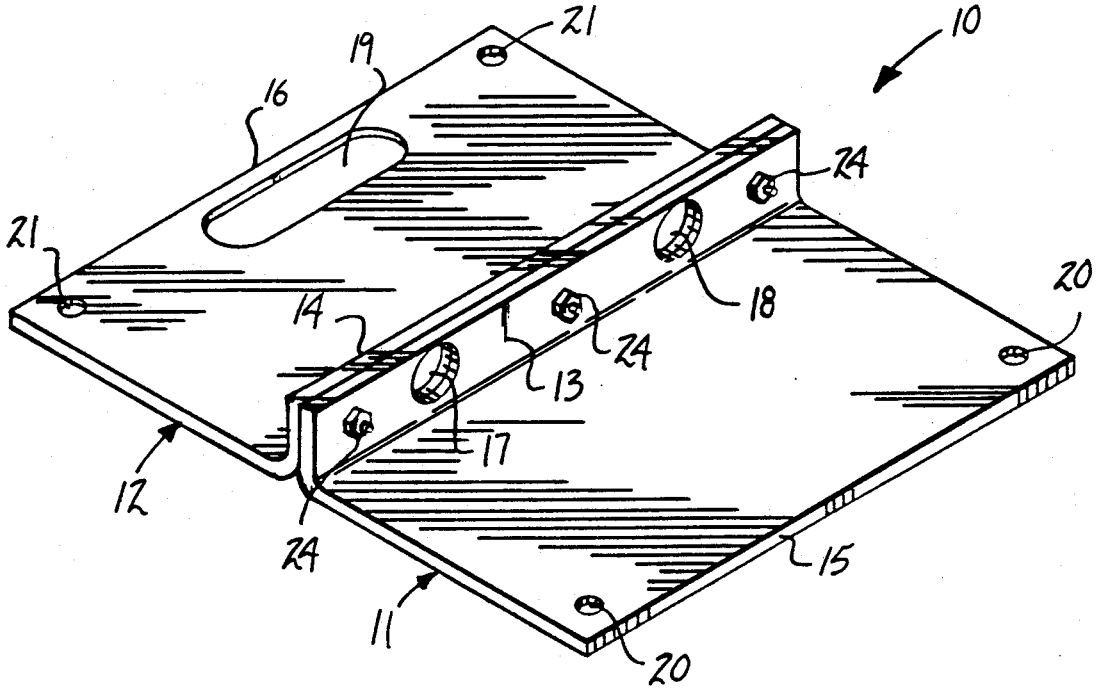
FIG. 1 is an isometric illustration of the instant invention.
Figure 2:
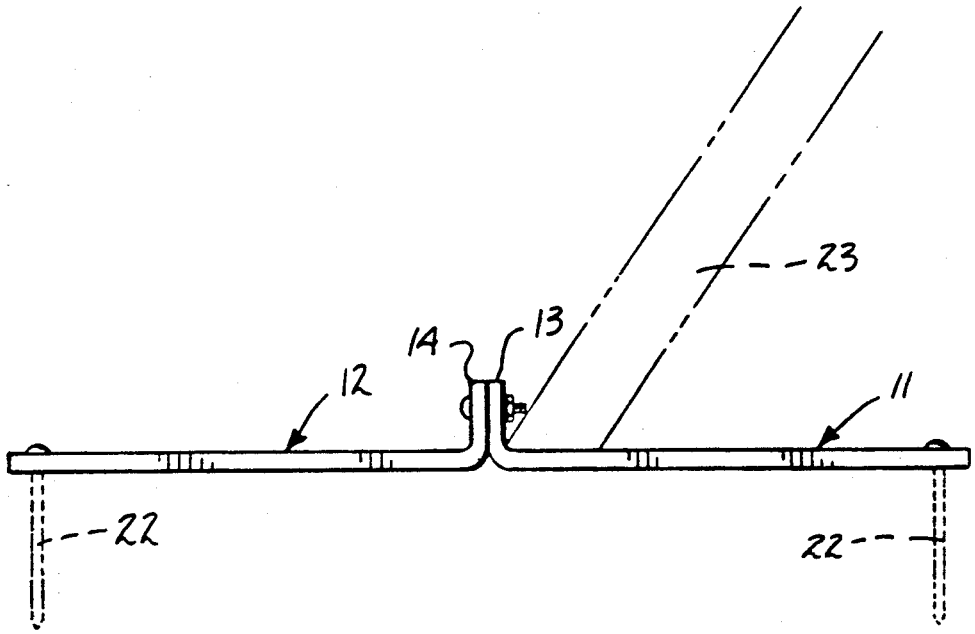
FIG. 2 is an orthographic side view of the invention.

With reference now to the drawings, and in particular to FIGS. 1 to 6 thereof, a new and improved ladder base plate apparatus embodying the principles and concepts of the present invention and generally designated by the reference numerals 10, 10*a*, and 10*b* will be described.

Figure 4:
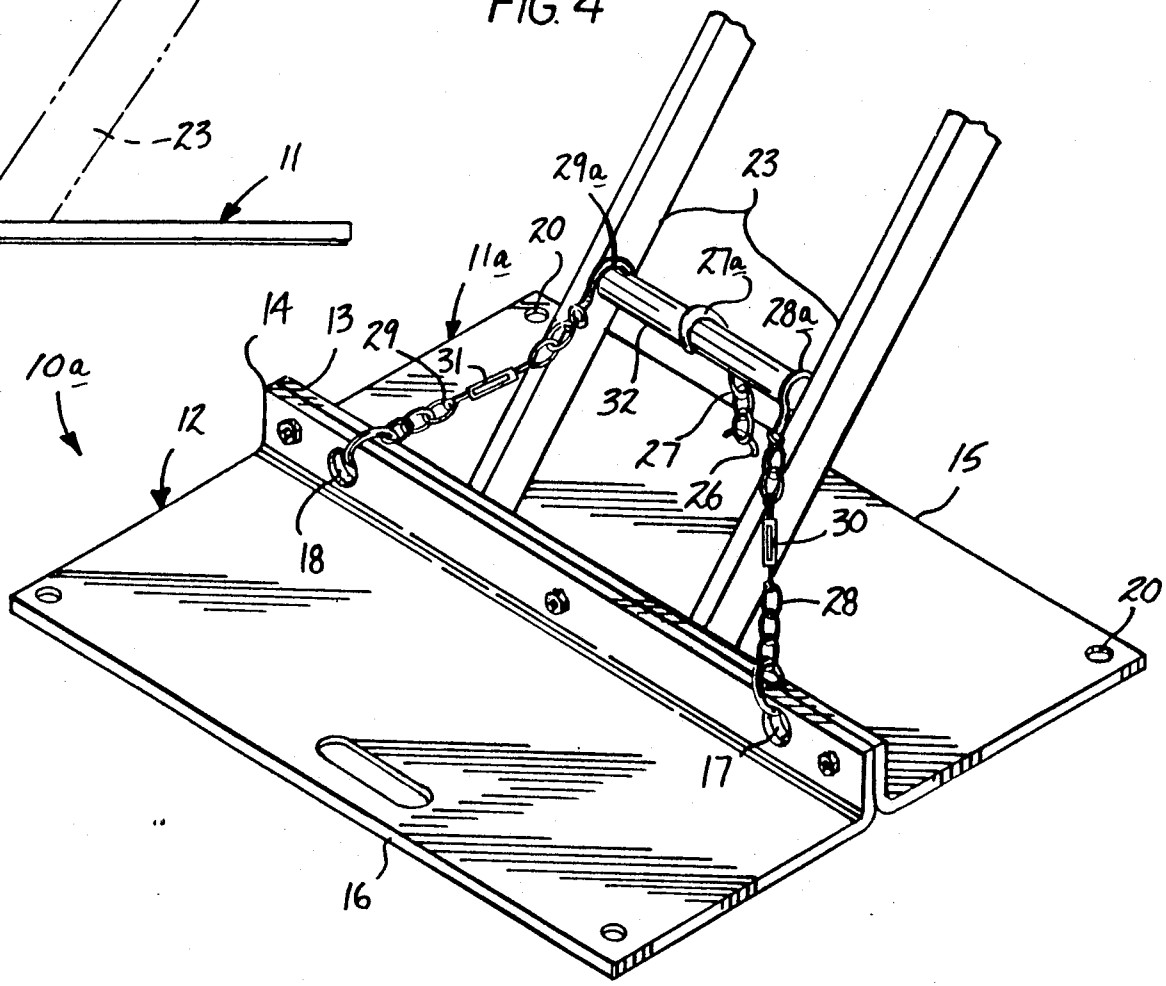
FIG. 4 is an isometric illustration of a modification of the invention.

More specifically, the ladder base plate apparatus 10 of the instant invention essentially comprises a first base plate member 11 arranged coplanar with a second base plate member 12. The first plate member 11 includes a first flange 13 in contiguous and coextensive relationship to a second flange 14 mounted to interior edges of the respective first and second plate members 11 and 12. The first and second flanges 13 and 14 are selectively secured together by utilization of a plurality of fasteners 24 that are orthogonally directed through the flanges to secure them together, as illustrated. A respective first and second bore 17 and 18 are orthogonally directed through the contiguous flanges 13 and 14 and spaced apart a predetermined first spacing that is greater than a second spacing defined between ladder legs 23, as illustrated in FIG. 4. A handle slot 19 is directed through the second plate member 12 adjacent the second exterior edge 16, wherein the first plate member 11 includes a first exterior edge 15. First plate mounting bores 20 are positioned at the corners of the first plate member adjacent the first edge 15, wherein second plate mounting bores 21 are directed through the second plate member 12 adjacent the second edge 16, with the bores positioned adjacent the corners of the plate member, as illustrated in FIG. 1 for example. Mounting spikes 22 are provided for projection through the mounting bores 20 and 21 for securement of the apparatus to a ground support for the associated ladder.

FIG. 4 illustrates the use of a modified apparatus 10*a*, wherein an anchor loop 26 is positioned medially of the first plate member 11 adjacent the first edge 15 and includes a first tether line 27, with a first hook 27*a* for securement to a lowermost ladder rung 32. The first and second bores 17 and 18 include respective second and third tether lines 28 and 29 that include respective second and third hooks 28*a* and 29*a* respectively that are also mounted to the lower ladder rung 32. Respective first and second turn buckles 30 and 31 are mounted to the respective second and third tether lines 28 and 29 to permit tensioning of the tether lines to secure the lower terminal ends of the ladder legs against the first flange 13 for stable securement of the ladder relative to the apparatus.

Figure 3:
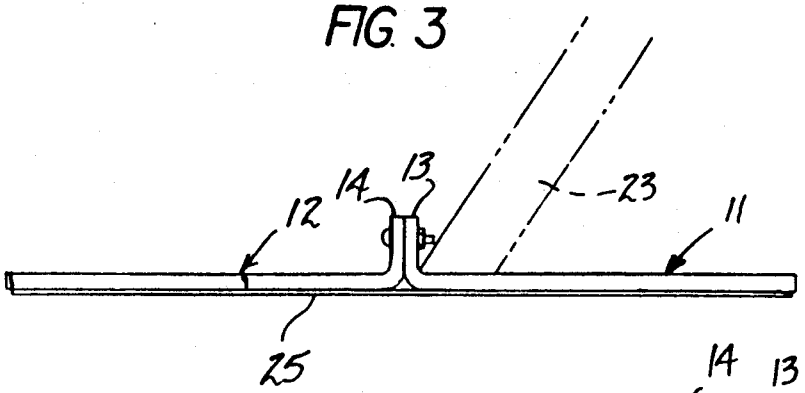
FIG. 3 is a further example of the instant invention utilizing an underlying traction layer.
Figure 5:
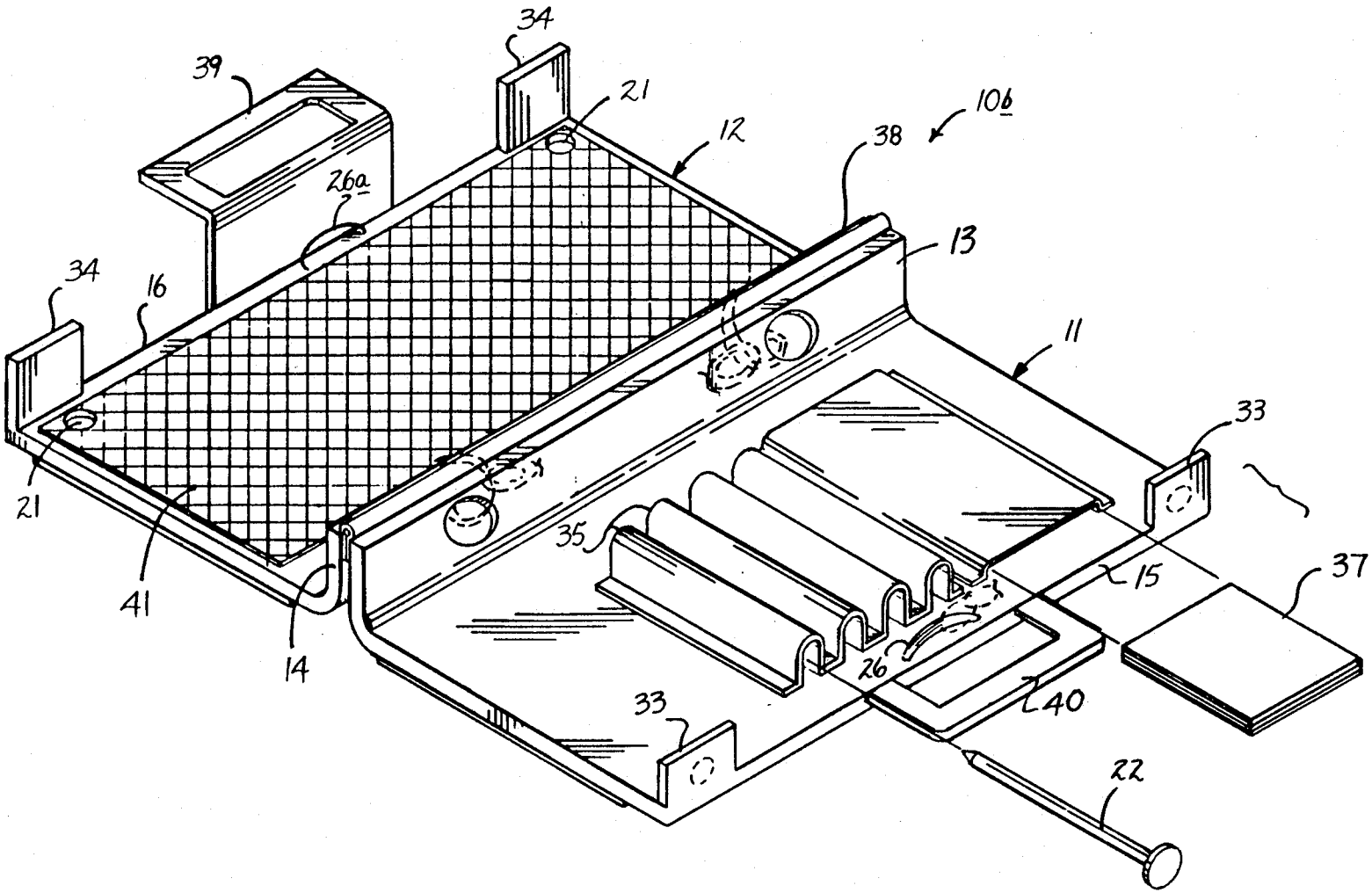
FIG. 5 is an isometric illustration of a further modification of the instant invention.
Figure 6:
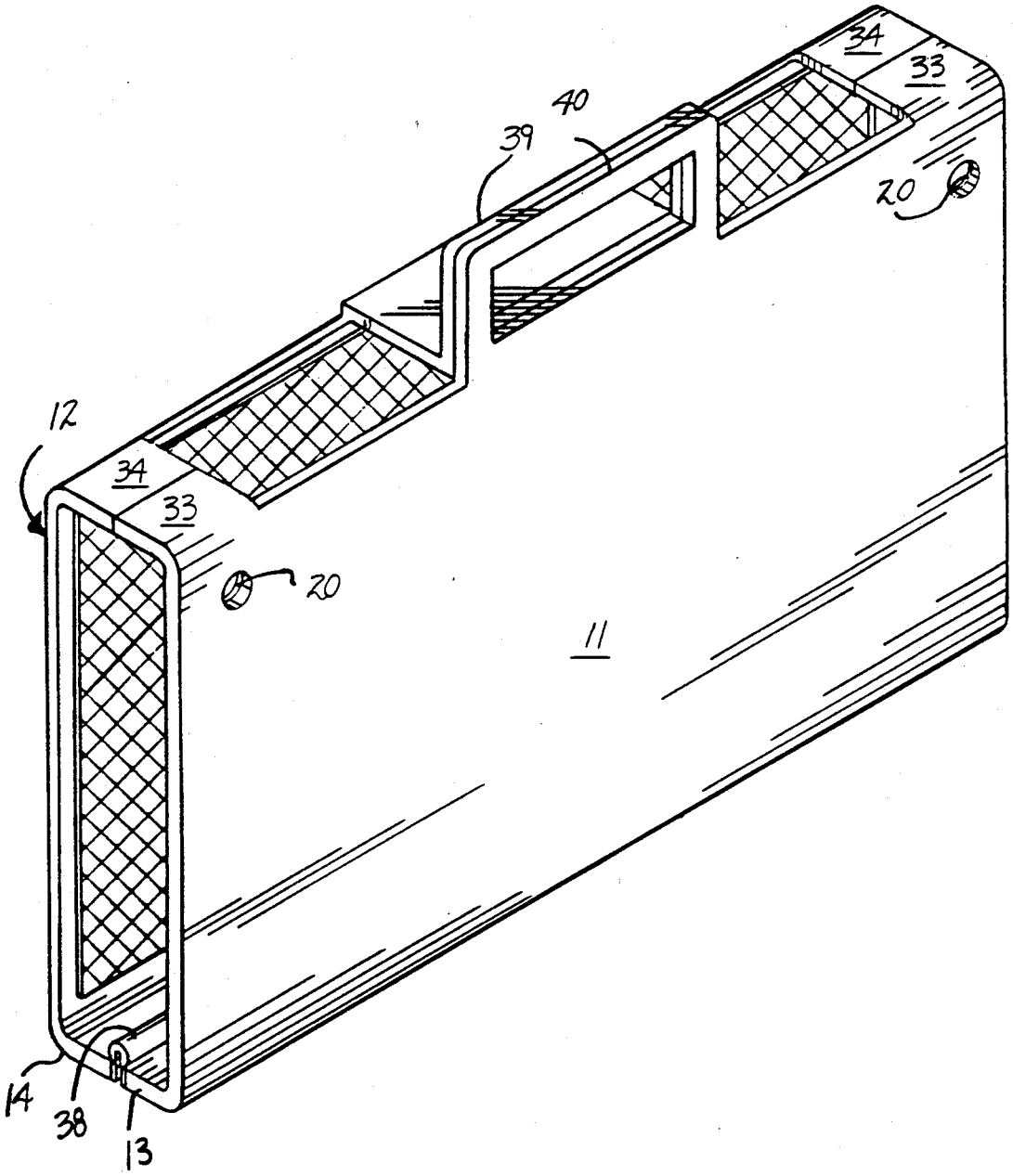
FIG. 6 is an isometric illustration of the modification of the invention as set forth in FIG. 5 in a folded configuration.

The apparatus 10*b*, as illustrated in FIGS. 5 and 6, present the structure utilizing first abutment flanges 33 mounted to the first edge 15 orthogonally oriented relative to the top surface of the first plate member 11, with second abutment flanges 34 orthogonally mounted adjacent the second edge 16 to provide for an enclosure cavity, as illustrated in FIG. 6, when the first plate member 11 is pivoted relative to the second plate member 12 about a hinge 13 hingedly mounting the first and second flanges 13 and 14 together. A plurality of tubular pockets 25 are provided and mounted to the top surface of the first plate 11 to receive the mounting spikes 22, wherein a rectangular pocket 36 is also provided and mounted to the top surface of the first plate member 11 to receive a flexible adhesion sheet 37. The adhesion sheet 37 is utilized in lieu of a flexible traction layer 25 that is permanently mounted to the bottom surface of the first and second plate members, as illustrated in FIG. 3, wherein the flexible adhesion sheet 37 is attached to an underlying surface, such as concrete and the like, wherein utilization of the spikes 22 are not convenient. Alternatively, the adhesion sheet may be permanently mounted to the exterior surface of the first and second plate members, in a manner as illustrated in FIG. 3. An "L" shaped second handle 39 is mounted to the second edge 16, while a planar first handle 40 coplanar with the top surface of the first plate member 11 is provided, wherein pivotment of the first and second plate members to a folded position, as illustrated in FIG. 6, provides for contiguous abutment of the first and second handles 40 and 39 together when the first and second abutment flanges 33 and 34 are in abutment. Further, a second friction pad 41 is mounted to the top surface of the second plate member 12 to provide an additional adhesion surface, if desired, for positioning a ladder thereon in cooperation with a further anchor loop 26*a*.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder base plate apparatus, comprising, a first base plate member secured to a second base plate member, wherein the first base plate member and the second base plate member are coplanar in a first position, and wherein the first base plate member includes a first flange mounted orthogonally along a first plate member interior edge, and a second flange contiguous with the coextensive the first flange mounted to a second plate member interior edge orthogonally oriented relative to the second plate member, and the first plate member includes a first plate member exterior edge, and the second plate member includes a second plate member exterior edge, and a plurality of first bores positioned adjacent the first plate member exterior edge adjacent the first plate member side edges, and the second plate member including second bores directed through the second plate member adjacent the second plate member exterior edge adjacent second plate member side edges, and the first and second bores each including a mounting spike projecting through each of the first and second bores for securement of the first and second plate members to an underlying surface.

2. An apparatus as set forth in claim 1 including a first flange bore orthogonally directed through the first flange and the second flange, and a second flange bore orthogonally directed through the first flange and the second flange, wherein first flange bore and the second flange bore are spaced apart a predetermined first spacing, and including a ladder member, wherein the ladder member includes ladder legs, the ladder legs spaced apart a second spacing, wherein the second spacing is less than the first spacing, and the first flange bore and the second flange bore including a respective first and second tether line secured thereto, and the first and second tether line including a respective first and second hook member, and the ladder member including a lower rung, and the first and second hook members securable about the lower rung, and the first and second tether line including a respective first and second turn buckle to effect selective linear adjustment of the first and second tether line.

3. An apparatus as set forth in claim 2 including an anchor loop mounted to the first plate member adjacent the first plate member exterior edge, and the anchor loop including a further tether line mounted to the anchor loop, and the further tether line including a further hook, the further hook securable about the lower rung of the ladder.

4. An apparatus as set forth in claim 3 wherein the first plate member includes a plurality of tubular pockets, each tubular pocket arranged for reception of a mounting spike therewithin.

5. An apparatus as set forth in claim 4 wherein the first plate member exterior edge includes a plurality of first abutment flanges orthogonally oriented relative to the first plate member, and the second plate member including a plurality of second abutment flanges mounted to the second plate member adjacent the second plate member exterior edge, and the first flange and the second flange include a hinge to hingedly mount the first plate member to the second plate member, wherein the first plate member and the second plate member are pivotal relative to one another to effect abutment of the first abutment flanges and the second abutment flanges in a second position, wherein the first plate member and the second plate member are parallel relative to one another, and a first handle coplanar with the first plate member exterior edge, and a second "L" shaped handle mounted to the second plate member exterior edge for abutment of the first handle and the second handle together when the first plate member and the second plate member are in the second position rotated from a first position when the first plate member and the second plate member are coplanar.

* * * * *